US009915003B2

(12) United States Patent
Gaertner

(10) Patent No.: US 9,915,003 B2
(45) Date of Patent: Mar. 13, 2018

(54) ELECTRICAL CONTACT ELEMENT

(71) Applicant: Delphi Technologies, Inc., Troy, MI (US)

(72) Inventor: Markus Gaertner, Wuppertal (DE)

(73) Assignee: DELPHI TECHNOLOGIES, INC., Troy, MI (US)

( * ) Notice: Subject to any disclaimer, the term of this patent is extended or adjusted under 35 U.S.C. 154(b) by 0 days.

(21) Appl. No.: 15/469,894

(22) Filed: Mar. 27, 2017

(65) Prior Publication Data

US 2017/0342571 A1 Nov. 30, 2017

(30) Foreign Application Priority Data

May 24, 2016 (EP) ..... 16171090

(51) Int. Cl.

| | |
|---|---|
| ***H01R 13/44*** | (2006.01) |
| ***C23F 13/00*** | (2006.01) |
| ***C23F 13/16*** | (2006.01) |
| ***H01R 4/26*** | (2006.01) |
| ***H01R 13/03*** | (2006.01) |
| ***H01R 4/64*** | (2006.01) |

(52) U.S. Cl.

CPC ..... *C23F 13/005* (2013.01); *C23F 13/16* (2013.01); *H01R 4/26* (2013.01); *H01R 4/64* (2013.01); *H01R 13/03* (2013.01); *C23F 2213/20* (2013.01); *C23F 2213/30* (2013.01)

(58) Field of Classification Search

CPC ..... H01T 13/06; H01R 4/20; H01R 13/113; H01R 4/5033

USPC ..... 428/615; 439/128, 886, 427, 852; 174/74 R, 84 C

See application file for complete search history.

(56) References Cited

U.S. PATENT DOCUMENTS

| | | | | |
|---|---|---|---|---|
| 6,451,449 | B2 * | 9/2002 | Asakura | C23C 28/023 174/74 R |
| 2001/0008709 | A1 | 7/2001 | Asakura et al. | |
| 2011/0014825 | A1 | 1/2011 | Drew et al. | |
| 2013/0040509 | A1 | 2/2013 | Mitose et al. | |
| 2016/0064847 | A1 | 3/2016 | Gaertner | |

FOREIGN PATENT DOCUMENTS

| | | | |
|---|---|---|---|
| EP | 1369504 | A1 | 12/2003 |
| JP | 2013182860 | A | 9/2013 |
| WO | 2015163439 | A1 | 10/2015 |
| WO | 2015174262 | A1 | 11/2015 |

OTHER PUBLICATIONS https://www.metalsupermarkets.com/which-metals-conduct-electricity/.*

* cited by examiner

*Primary Examiner* — Phuong Chi T Nguyen
(74) *Attorney, Agent, or Firm* — Robert J. Myers

(57) ABSTRACT

An electrical contact element formed of sheet metal having a first region and a second region. Each one of the first and second regions is coated with a coating including a first layer containing a first material having a lower standard electrode potential than the sheet metal material. The coating includes a second layer in the first region which is absent in the second region. The second layer is arranged underneath the first layer and contains a second material that has a lower standard electrode potential than the first material.

24 Claims, 3 Drawing Sheets

ELECTRICAL CONTACT ELEMENT

CROSS-REFERENCE TO RELATED APPLICATION

This application claims the benefit under 35 U.S.C. § 119(a) of patent application Ser. No. 16/171,090.0 filed in the European Patent Office on May 24, 2016, the entire disclosure of which is hereby incorporated by reference.

TECHNICAL FIELD OF THE INVENTION

The present invention relates to an electrical contact element comprising a sheet metal made of a sheet metal material and having a first region and a second region, wherein each one of the first and second regions is coated with a coating including a first layer containing a first material having a lower standard electrode potential than the sheet metal material.

BACKGROUND OF THE INVENTION

More than ever, climate protection is a topic of great relevance. One effort in this field is directed to reduce fuel consumption of vehicles and to consequently lower emission of greenhouse gases such as carbon dioxide by decreasing the weight of a vehicle. Yet, in vehicles, safety aspects and consumer demands require sophisticated electrical wiring leading to an increase in vehicle weight. In order to satisfy both, climate protection and low vehicle weight, lightweight materials such as aluminum may be employed for electrical wiring. However, aluminum is prone to oxidation, when exposed to oxygen from ambient air, which will create a thin layer of electrically insulating aluminum oxide. As a consequence electrical conductivity will be lowered, which, for example, may lead to malfunction of an electronic device fed via an aluminum line of the wiring. In order to still ensure optimum electrical conductivity, an end section of the aluminum line may be connected to an electrical contact element containing a noble material, such as copper, which oxidizes less easily.

When aluminum and copper are in contact in the presence of an electrolyte such as salt containing water, galvanic corrosion will occur due to the rather large difference in the standard electrode potentials of aluminum and copper. This corrosion will lead to the consumption of the material having the lower standard electrode potential (here aluminum) and/or to the creation of a gap between the wire electrical cable and the electrical contact element, ultimately resulting in a poor quality of the contact between the wire electrical cable and the contact element.

Previous attempts to reduce corrosion were directed to inserting at least one intermediate layer between the wire electrical cable and the electrical contact element, with the at least one intermediate layer containing a material having a standard electrode potential ranking between the standard electrode potential of the wire electrical cable material and the sheet metal material of the electrical contact element.

In order to reduce corrosion even further, an additional layer was arranged between the electrical contact element and the at least one intermediate layer, with the additional layer comprising a material having a lower standard electrode potential than the sheet metal material of the electrical contact element and the material contained in the intermediate layer. The material of the additional layer thus exhibited the lowest standard electrode potential of all layers and therefore would be preferably oxidized, i.e. the additional layer consisted of an easily corrodible material. By corroding, the additional layer protects not only the intermediate layer but also the electrical contact element and the wire electrical cable against corrosion. However, as corrosion of the additional layer gradually proceeds, an electrically insulating layer is formed which in turn will increase the electrical resistance between the wire electrical cable and the electrical contact element and thereby deteriorate the quality of the contact between the contact element and the wire electrical cable.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

It is an object of the electrical contact element presented herein to maintain optimum electrical contact properties even after longer periods of use. This object is satisfied by an electrical contact element in which, the coating includes a second layer in the first region which is absent in the second region. The second layer is arranged underneath the first layer and contains a second material that has a lower standard electrode potential than the first material.

By providing a layer containing an easily corrodible material only partially on the electrical contact element, instead of entirely coating the electrical contact element with this layer, better protection against corrosion and thereby an optimum quality of the contact of an electrical contact element and a wire electrical cable over a longer period of use can be achieved. Thereby, the layer of easily corrodible material prevents corrosion of both the electrical contact element and the wire electrical cable, while at the same time an optimum electrical conductivity between the electrical contact element and the wire electrical cable is ensured in the second region where the easily corrodible material is absent.

The coating may comprise an additional third layer made of an alloy of a third material. A particularly good protection against corrosion can be achieved by arranging the second layer between the first layer and the third layer.

Protection against corrosion can be enhanced if the electrical contact element further comprises at least one further region containing the second material.

According to an embodiment, the electrical contact element further comprises a third region separated from the first region by the second region, wherein the third region is coated with a coating comprising a first layer containing the first material, and a second layer arranged underneath the first layer and containing the second material. In this embodiment, a third layer made of an alloy of the third material is absent in the third region.

According to a further embodiment, the electrical contact element further comprises a third region separated from the first region by the second region, wherein the third region is coated with a coating comprising a first layer containing the first material, a second layer containing the second material and a third layer made of an alloy of the third material. The second layer may be arranged underneath the first layer which may form an outer layer and the third layer may be arranged underneath the second layer.

Preferably, the first, second and third regions are arranged one after another in a longitudinal direction of the electrical contact element, so that the first and third regions are separated by the second region in the longitudinal direction of the electrical contact element.

The second region separating the first region from the third region defines a distance between the first and third regions. A good trade-off between optimum protection against corrosion and optimum electrical conductivity is achieved when the distance ranges between 1 mm and 8 mm. More preferably, the distance has a value between 2 mm and 6 mm and, most preferably, the distance has a value between 2.5 mm and 4.5 mm.

It should be understood that the electrical contact element may also comprise further regions having a coating including the first layer but no second layer and/or third layer. Furthermore, the electrical contact element may comprise a region having no coating of the above kind at all. For example, such a region may be defined by a terminal portion of the electrical contact element for mating the contact element with a complementary contact element.

As the second material contained in the second layer will be easily corroded and may thus form an electrically insulating layer, the first region preferably forms at least a part of a fastening section of the electrical contact element for mechanically securing the electrical contact element to a wire electrical cable. The second region in which the second layer is absent preferably forms at least a part of a connecting section of the electrical contact element for electrically connecting the electrical contact element to the wire electrical cable.

The electrical contact element and, in particular, the fastening section and/or the connecting section may be formed from a metal blank by a punching process followed by a forming process, for example, by means of a press-brake. Instead of a punching process any other separation technique, such as laser cutting or water jet cutting, may be employed.

Punching or cutting to form the sheet metal may be performed at any step during deposition of the layers, although it is preferred to perform the punching or cutting of the sheet metal prior to the deposition of the layers so that the edges of the sheet metal are also coated with the coating, which leads to a better protection against corrosion.

The wire electrical cable preferably comprises aluminum or an alloy thereof, as aluminum has a low density and good electrical conductivity. Using aluminum lines leads to a lower vehicle weight and less emission of greenhouse gases. In order to ensure optimum conductivity between two or more mating electrical contact elements, the sheet metal may be made of copper or an alloy thereof. If the line comprises aluminum or an alloy thereof and the sheet metal is made of copper or an alloy thereof, tin may be a preferable material for the first layer, as its standard electrode potential is ranking between a standard electrode potential of the sheet metal material and a standard electrode potential of the wire electrical cable material. Preferably, the tin contained in the first layer is matte tin. In this context, the term "is made of a material" is to be understood as "consisting of this material and possibly some unavoidable impurities".

Advantageously, the second layer forms a galvanic anode. For example, the second layer may be made of zinc, although other materials having a lower standard electrode potential than the first material, such as chromium or niobium, may be also employed. Since the second material contained in the third layer is sacrificed while corrosion proceeds, the second layer may also be referred to as a sacrificial anode.

The second layer may be provided in the first and third regions either in separate steps or simultaneously, i.e. in one step.

In order to deposit the second layer in the first region and, optionally, in the third region, the second region may be covered with a masking material prior to the deposition of the second layer. After deposition of the second layer, removal of the masking material will also remove the second layer deposited onto the masking material in the second region, so that, as a result, the second layer will be absent in the second region.

It is also possible to deposit the second layer in both the first and second regions and, optionally in the third region and then to remove the second layer from the second region, for example, by electro polishing, mechanical abrasion or laser ablation. Herein the removable masking material may also be used to protect the first region and, optionally the third region, during the removal of the second layer in the second region. The masking material may be an adhesive tape, a photo resist which may be structured by means of photolithography or any other type of removable sacrificial layer.

The third layer may be made of an alloy of a third material which is also contained in the sheet metal. Especially, the alloy may contain copper and zinc. Preferably, the copper zinc alloy contains zinc in an amount of 30% to 40% by weight.

It is to be understood that the coating may comprise further layers in addition to the third, second and/or third layers. Preferably, the standard electrode potential of the further layers will range between the standard electrode potentials of the electrical contact element and the wire electrical cable. Moreover, the number of further layers may be different in the first, second and third regions.

The deposition of the layers may comprise any deposition technique such as, for example, electroplating, vacuum deposition techniques, hot-dip galvanization, powder coating, etc. Increased adhesion of each of the first, second and third layers may be achieved by depositing thin layers of primer materials prior to the deposition of the first, second and third layers.

Optionally, the sheet metal may comprise a hot dip tin layer which is provided between the sheet metal and the coating. It is to be understood that this optional tin layer may also be deposited onto the sheet metal by means of other deposition techniques such as vacuum vapor deposition or sputtering.

Further subject matter of the invention is an electrical contact element comprising a sheet metal made of a sheet metal material and having a first region and a second region, wherein each one of the first and second regions is coated with a coating including a first layer containing a first material having a lower standard electrode potential than the sheet metal material. In the first and second regions, the coating includes a second layer which contains a second material having a lower standard electrode potential than the first material and which is arranged underneath the first layer. The coating further includes a third layer made of an alloy of a third material, which is arranged between the first and second layers. This third layer may exclusively be present in the second region, i.e. the third layer may be absent in the first region. Alternatively, a third layer made of an alloy of a third material and arranged between the first and second layers may not only be present in the second region but also in the first region.

According to an embodiment, the electrical contact element may further comprise a third region separated from the first region by the second region, wherein the third region is coated with a coating comprising a first layer containing the first material, a second layer arranged between the sheet metal and the first layer and containing the second material, and optionally a third layer made of an alloy of the third material and arranged between the first and second layers.

Further benefits and advantageous embodiments of the invention will become apparent from the dependent claims, from the description and from the accompanying drawings.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1:
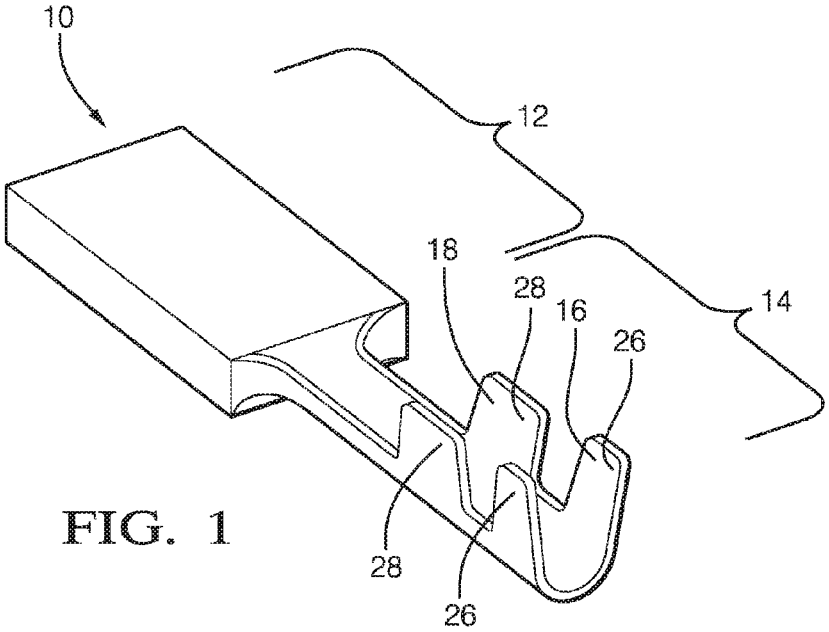
FIG. 1 is a schematic perspective view of an electrical contact element according to the invention.
Figure 2:
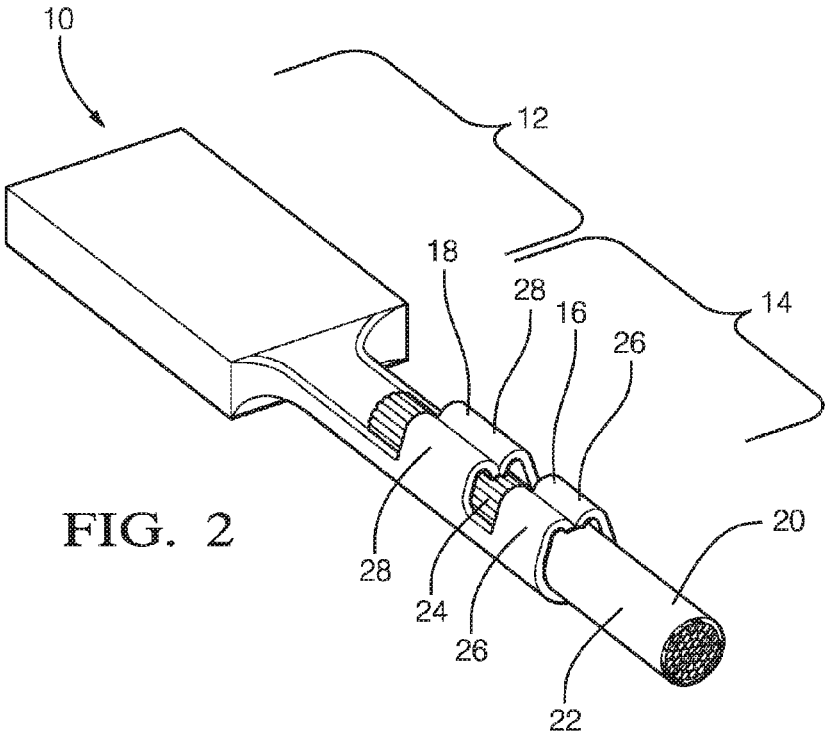
FIG. 2 is a schematic perspective view of the electrical contact element of FIG. 1 connected to a wire electrical cable.

FIG. 1 shows a non-limiting example of an electrical contact element 10 according to the invention. The electrical contact element 10 has a terminal portion 12 and a connection portion 14. The terminal portion 12 is for connecting the electrical contact element 10 to at least one mating electrical contact element (not shown), whereas the connection portion 14 comprises a fastening section 16 and a connecting section 18 and is for connecting the electrical contact element 10 to a wire electrical cable 20 (FIG. 2).

The wire electrical cable 20 comprises an insulation 22 surrounding a plurality of aluminum wires 24. Although shown as multiple stranded aluminum wires 24 in the present case, the wire electrical cable 20 could comprise only a single aluminum wires 24.

The fastening section 16 of the electrical contact element 10 has a pair of first crimp wings 26 and the connecting section 18 has a pair of second crimp wings 28. An electrical connection between the wire electrical cable 20 and the electrical contact element 10 is obtained by removing the insulation 22 from an end portion of the wire electrical cable 20, inserting the wire electrical cable 20 longitudinally in between the first and second crimp wings 26, 28, so that an insulated portion of the wire electrical cable 20 is located between the first crimp wings 26 and the bare aluminum wires 24 are located between the second crimp wings 28, and crimping the first and second crimp wings 26, 28 by means of a crimp tool (not shown), so that the first crimp wings 26 engage with the insulation 22 thereby mechanically securing the electrical contact element 10 to the wire electrical cable 20 and the second crimp wings 28 engage with the aluminum wires 24 thereby electrically contacting the aluminum wires 24.

It is to be understood that the number of fastening sections 16, connecting sections 18, first crimp wings 26 and/or second crimp wings 28 may depart from the number shown in the drawings. Furthermore, the terminal portion 12, the connection portion 14, the fastening section 16 including the first crimp wings 26, and/or the connecting section 18 including the second crimp wings 28 may have different sizes and shapes.

Figure 3A:
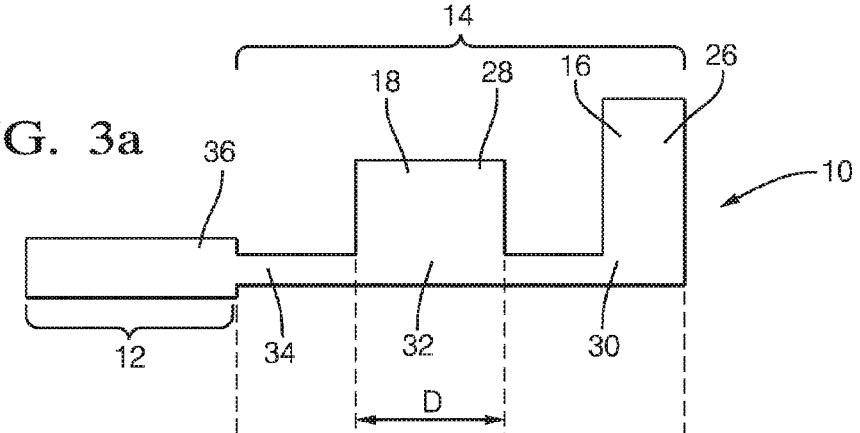
FIG. 3*a* is a schematic side view of the electrical contact element of FIG. 1.

FIG. 3*a* shows a schematic side view of the electrical contact element 10. The connection portion 14 of the electrical contact element 10 comprises a first region 30 which includes the first crimp wings 26, a second region 32 which includes the second crimp wings 28, and a third region 34. The first region 30 and the third region 34 are separated by a distance D by the second region 32 in a longitudinal direction of the electrical contact element 10, and the third region 34 abuts the terminal portion 12 which defines a fourth region 36. The distance D may have a value between 1 mm and 8 mm, more preferably between 2 mm and 6 mm and most preferably between 2.5 mm and 4.5 mm.

In the present case, the first region 30 coincides with the fastening section 16 and the second region 32 coincides with the connecting section 18 as is illustrated by vertical dashed lines in FIGS. 3*a* to 3*c* and FIGS. 4*a* to 5. However, it is to be understood that the first region 30 may extend into a part of the connecting section 18 and/or that the second region 32 may extend into a part of the fastening section 16.

As shown in FIGS. 3*b* to 3*d*, 4*b* and 5, the electrical contact element 10 comprises a sheet metal 38 which is made of copper and which is provided with a thin layer 40 of hot dip tin. In addition, the connection portion 14 of the electrical contact element 10 is coated with a selective metal coating that will be described in more detail below.

Figure 3B:
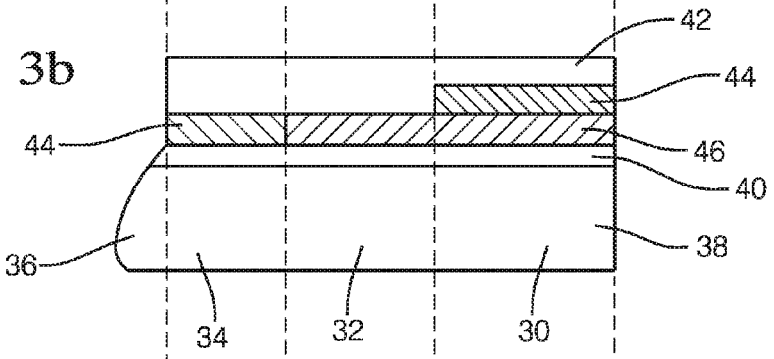
FIG. 3*b* is a schematic partial cross-sectional view of a coating of an electrical contact element according to a first embodiment.

According to a first embodiment illustrated in FIG. 3*b*, the coating in the first region 30 contains a first layer 42, a second layer 44 and a third layer 46, wherein the first layer 42 forms an outer layer and the second layer 44 is arranged underneath the first layer 42. More specifically, the second layer 44 is provided between the first layer 42 and the third layer 46, wherein the third layer 46 is arranged on top of the layer 40 of hot dip tin.

In the second region 32, the coating contains the first layer 42 and the third layer 46. Again, the first layer 42 forms an outer layer and the third layer 46 is arranged on top of the layer 40 of hot dip tin. In contrast to the coating in the first region 30, the second layer 44 is absent in the coating in the second region 32.

In the third region 34, the coating contains the first layer 42 and the second layer 44, whereas the third layer 46 absent. In other words, the first layer 42 forms an outer layer and the second layer 44 is arranged between and is in contact with the layer 40 of hot dip tin and the first layer 42.

Figure 3C:
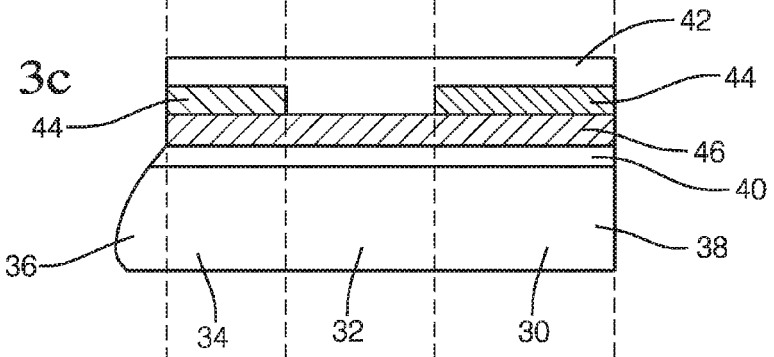
FIG. 3*c* is a schematic partial cross-sectional view of a coating of an electrical contact element according to a second embodiment.

FIG. 3*c* shows a coating of the connection portion 14 according to a second embodiment. This coating differs from the coating shown in FIG. 3*b* in that a layer structure in the third region 34 corresponds to the layer structure in the first region 30, i.e. the third region 34 comprises not only the first and second layers 42, 44 but also the third layer 46 wherein the first layer 42 forms an outer layer and the second layer 44 is arranged between the first layer 42 and the third layer 46.

Figure 3D:
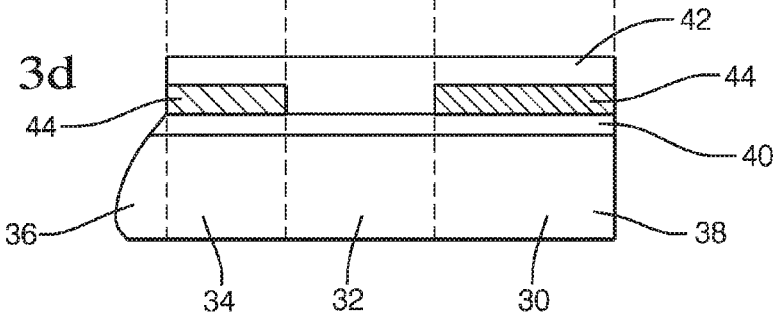
FIG. 3*d* is a schematic partial cross-sectional view of a coating of an electrical contact element according to a third embodiment.

In FIG. 3*d* a coating of the connection portion 14 according to a third embodiment is depicted. This coating differs from the coating shown in FIG. 3*c* in that the third layer 46 is absent in the first, second and third regions 30, 32, 34.

In either case, the terminal portion 12 of the electrical contact element 10 does not comprise any coating of the sort described above, i.e. the layer 40 of hot dip tin forms an outer layer in the fourth region 36.

In all embodiments shown in FIGS. 3*b* to 3*d*, 4*b* and 5, the first layer 42 is made of matte tin. The second layer 44 is made of zinc. The third layer 46 is made of an alloy of copper and zinc, with the copper zinc alloy preferably containing zinc in an amount of 30% to 40% by weight.

As can be seen in FIGS. 3*b* to 3*d*, the first region 30 and the third region 34 comprise a coating containing the second layer 44, whereas the second layer 44 is absent in the second region 32. Compared to the standard electrode potentials of copper contained in the sheet metal 38, tin contained in the first layer 42 and aluminum contained in the aluminum wires 24, zinc contained in the second layer 44 has the lowest standard electrode potential and, hence, will corrode more easily. More specifically, the zinc will be oxidized to an insulating material such as zinc oxide which will decrease conductivity. Since the second layer 44 is absent in the second region 32, such an insulating layer cannot form there, thus ensuring optimum electrical conductivity in the second region 32.

A method for manufacturing an electrical contact element 10 according to the first embodiment will now be described. Initially, a sheet metal 38 is covered by a layer 40 of hot dip tin by submerging the sheet metal 38 in molten tin. Alternatively, a commercially available hot dip tin coated sheet metal may be employed. Next, a first region 30 and a second region 32 will be coated with a third layer 46 containing a copper zinc alloy by immersing the first and second regions 30, 32 in an electroplating bath containing a copper zinc electrolyte.

After deposition of the third layer 46 in the first and second regions 30, 32, a second layer 44 is deposited onto the third layer 46 in the first region 30 by immersing the first region 30 in an electroplating bath containing a zinc electrolyte. Subsequent to depositing the second layer 44 in the first region 30, the electrical contact element 10 is rotated by at least approximately 180° and dipped into the electroplating bath containing the zinc electrolyte up to the second region 32, so that a third region 34 is immersed in the electroplating bath containing the zinc electrolyte, thus depositing the second layer 44 in the third region 34.

By again rotating the electrical contact element 10 by at least approximately 180° and immersing the first, second and third regions 30, 32, 34 in an electroplating bath containing a tin electrolyte, a first layer 42 is deposited in the first, second and third regions 30, 32, 34, thus creating an outer layer of matte tin on the electrical contact element 10, particularly, in the connection portion 14 of the electrical contact element 10.

An electrical contact element 10 according to the second embodiment is coated in a similar manner, except that the third layer 46 is deposited in all of the first, second and third regions 30, 32, 34 by immersing the first, second and third regions 30, 32, 34 in the electroplating bath containing the copper zinc electrolyte.

Alternatively, instead of depositing the second layer 44 separately in the first region 30 and the third region 34 as described above, the second layer 44 may be deposited simultaneously in the first and third regions 30, 34, i.e. in a single step, by masking the second region 32 with a removable masking material, such as an adhesive tape, prior to the deposition of the second layer 44. After deposition of the second layer 44 in all of the first, second and third regions 30, 32, 34 and removal of the masking material and the second layer 44 from the second region 32, the electrical contact element 10 can then be covered with the first layer 42 by immersing all of the first, second region and third regions 30, 32, 34 into the electroplating bath containing the tin electrolyte.

According to a further alternative method, the second layer 44 may be deposited simultaneously in the first, second and third regions 30, 32, 34. The removable masking material may then be used to protect the deposited second layer 44 in the first and second regions 30, 34 during removal of the second layer 44 in the second region 32, for example, by electro polishing, mechanical abrasion or laser ablation.

An electrical contact element 10 according to the third embodiment is manufactured in a similar manner as is described for the electrical contact element 10 according to the second embodiment, except that the step of providing the third layer 46 by immersing the first, second and third regions 30, 32, 34 in the electroplating bath containing the copper zinc electrolyte is omitted.

Figure 4A:
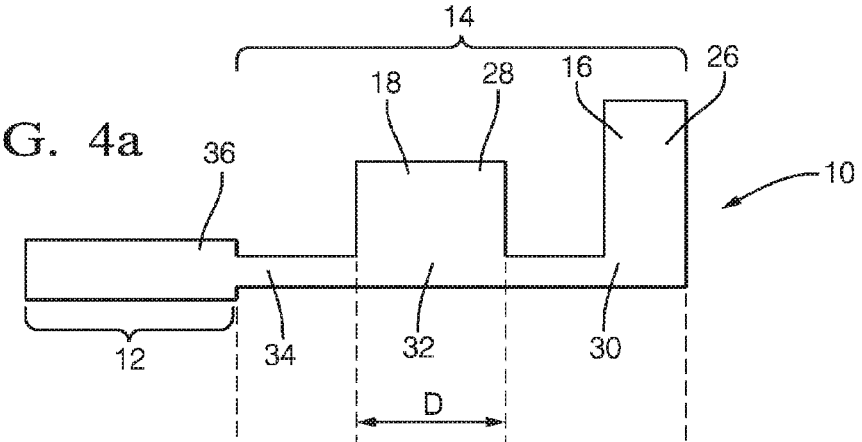
FIG. 4*a* is a schematic side view of the electrical contact element of FIG. 1.

As in FIG. 3*a*, FIG. 4*a* shows a schematic side view of an electrical contact element. Again, the electrical contact element 10 has four regions 30, 32, 34, 36 as described above.

Figure 4B:
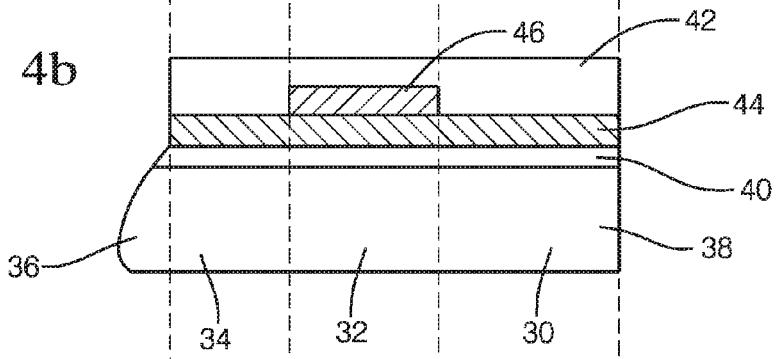
FIG. 4*b* is a schematic partial cross-sectional view of a coating of an electrical contact element according to a fourth embodiment.

In FIG. 4*b* a schematic side view of an electrical contact element 10 according to a fourth embodiment is depicted. Here, the sheet metal 38 is coated with a first layer 42 containing tin and a second layer 44 containing zinc in all of the first, second and third regions 30, 32, 34, wherein the first layer 42 forms an outer layer and the second layer 44 is arranged on top of a layer 40 of hot dip tin covering the sheet metal 38. Additionally, in the second region 32, a third layer 46 made of an alloy of copper and zinc is arranged between the first layer 42 and the second layer 44, i.e. the third layer 46 is absent in the first and third regions 30, 32.

Figure 5:
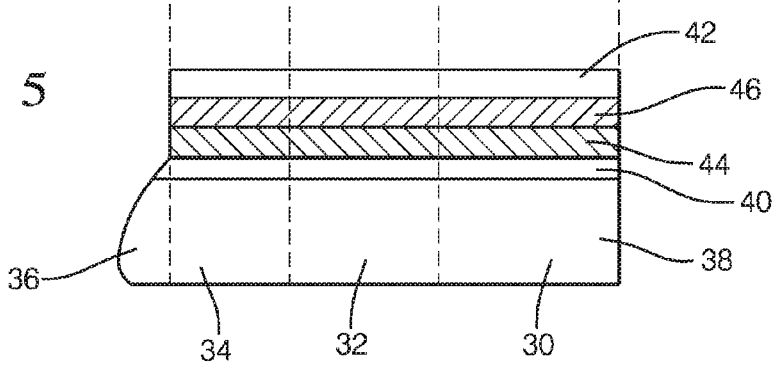
FIG. 5 is a schematic partial cross-sectional view of a coating of an electrical contact element according to a fifth embodiment.

FIG. 5 illustrates a schematic side view of an electrical contact element 10 according to a fifth embodiment which differs from the fourth embodiment in that the third layer 46 is also arranged between the first and second layers 42, 44 in the first and third regions 30, 34. In other words, all of the first, second and third regions 30, 32, 34 are covered with the layer 40 of hot dip tin, on top of which the second layer 44 is arranged, which is coated by the third layer 46, which again is covered by the first layer 42 forming an outer layer.

Although shown as if the third region 34 is entirely covered by the second layer 44, the third region 34 may also be coated only partially with the second layer 44, depending on the depth of immersion in the electroplating bath containing the zinc electrolyte. By immersing the electrical contact element 10 in the electroplating bath containing the copper and zinc electrolytes to a greater depth, a third layer 46 will form, which not only covers the second layer 44 but also contacts the layer 40 of hot dip tin to a certain extent. The same also applies to the first layer 42.

The distance between the first and third regions 30, 34, the materials and the deposition methods described in the context of the first, second and third embodiments are also applicable to an electrical contact element 10 according to the fourth and fifth embodiments.

For all embodiments in which the first layer 42 is deposited onto the second layer 44, a thin layer of a primer material may be deposited onto the second layer 44 in the first and third regions 30, 34 prior to the deposition of the first layer 42, as the zinc of the second layer 44 may partially dissolve in the electroplating bath containing the tin electrolyte and thereby contaminate the electroplating bath containing the tin electrolyte. This will prevent zinc from getting dissolved in the electroplating bath containing the tin electrolyte. The primer material may be deposited by means of electroplating, for example, using a tin electrolyte different from the tin electrolyte used for the first layer 42.

Typically, the electrical contact element 10 is punched or cut from a metal blank. This punching or cutting process may generally be performed at any step of the above described methods. Preferably, though, the punching or cutting of the electrical contact element 10 is carried out prior to the deposition of the layers 40, 42, 44, 46 so that punching or cutting edges are also coated with the coating, which leads to a better protection against corrosion.

It should be understood that in FIGS. 3*b* to 3*d*, 4*b* and 5 the thicknesses of the layers 40, 42, 44, 46 are not to scale. In fact, the layers 40, 42, 44, 46 may have different thicknesses in each of the first, second, third and fourth regions 30, 32, 34, 36. Preferably, the thicknesses of each layer 40, 42, 44, 46 may range between 0.5 μm and 20 μm.

Furthermore, although the layer 40 of hot dip tin and the first, second and third layers 42, 44, 46 are depicted with constant layer thicknesses and sharp interfaces, it is to be understood that the layer thickness of a layer may gradually decrease in the longitudinal direction of the electrical contact element 10 at the end of the layer. Apart from that, atomic diffusion may occur at the interfaces of layers containing different materials.

For the sake of completeness, it is noted that even though FIGS. 3*b* to 3*d*, 4*b* and 5 show only a top surface of the sheet metal 38 coated with a coating comprising at least two of the first, second and third layers 42, 44, 46, it is to be understood that a bottom surface and/or edge surfaces of the sheet metal 38 may also be provided with such a coating.

While this invention has been described in terms of the preferred embodiments thereof, it is not intended to be so limited, but rather only to the extent set forth in the claims that follow. Moreover, the use of the terms first, second, primary secondary, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

I claim:

1. An electrical contact element formed of a sheet metal material, comprising:

a first region;

a second region, wherein each one of the first and second regions is coated with a first coating including a first layer containing a first material having a lower standard electrode potential than the sheet metal material, wherein the first coating includes a second layer in the first region which is absent in the second region and wherein the second layer is arranged underneath the first layer and contains a second material having a lower standard electrode potential than the first material; and a third region separated from the first region by the second region, wherein the third region is coated with a second coating comprising a first layer containing the first material, and a second layer arranged underneath the first layer and containing the second material, a third layer made of an alloy of the third material being absent in the third region.

2. The electrical contact element according to claim 1, wherein the second region defines a distance between the first region and the third region, the distance having a value between 1 mm and 8 mm.

3. The electrical contact element according to claim 1, wherein the first region forms at least a part of a fastening section of the electrical contact element for mechanically fastening the electrical contact element to a wire electrical cable and the second region forms at least a part of a connecting section of the electrical contact element for electrically connecting the electrical contact element to the wire electrical cable.

4. The electrical contact element according to claim 1, wherein the sheet metal is made of copper or an alloy thereof, the first layer is made of a material having a standard electrode potential ranking between a standard electrode potential of the sheet metal material and a standard electrode potential of the wire electrical cable material, and/or the first layer is made of tin.

5. The electrical contact element according to claim 1, wherein the second layer forms a galvanic anode made of zinc.

6. The electrical contact element according to claim 1, wherein a hot dip tin layer is provided between the sheet metal and the first coating.

7. The electrical contact element according to claim 1, wherein the first coating includes an additional third layer made of an alloy of a third material and the second layer is arranged between the first layer and the third layer.

8. The electrical contact element according to claim 7, wherein the alloy of the third layer is a copper zinc alloy containing zinc in an amount of 30% to 40% by weight.

9. An electrical contact element formed of a sheet metal material, comprising:

a first region;

a second region, wherein each one of the first and second regions is coated with a first coating including a first layer containing a first material having a lower standard electrode potential than the sheet metal material, wherein the first coating includes a second layer in the first region which is absent in the second region and wherein the second layer is arranged underneath the first layer and contains a second material having a lower standard electrode potential than the first material; and a third region separated from the first region by the second region, wherein the third region is coated with a second coating comprising a first layer containing the first material, a second layer containing the second material and a third layer made of an alloy of the third material, wherein the second layer is arranged between the first and third layers.

10. The electrical contact element according to claim 9, wherein the second region defines a distance between the first region and the third region, the distance having a value between 1 mm and 8 mm.

11. The electrical contact element according to claim 9, wherein the first region forms at least a part of a fastening section of the electrical contact element for mechanically fastening the electrical contact element to a wire electrical cable and the second region forms at least a part of a connecting section of the electrical contact element for electrically connecting the electrical contact element to the wire electrical cable.

12. The electrical contact element according to claim 9, wherein the sheet metal is made of copper or an alloy thereof, the first layer is made of a material having a standard electrode potential ranking between a standard electrode potential of the sheet metal material and a standard electrode potential of the wire electrical cable material, and/or the first layer is made of tin.

13. The electrical contact element according to claim 9, wherein the second layer forms a galvanic anode made of zinc.

14. The electrical contact element according to claim 9, wherein a hot dip tin layer is provided between the sheet metal and the first coating.

15. The electrical contact element according to claim 9, wherein the first coating includes an additional third layer made of an alloy of a third material and the second layer is arranged between the first layer and the third layer.

16. The electrical contact element according to claim 15, wherein the alloy of the third layer is a copper zinc alloy containing zinc in an amount of 30% to 40% by weight.

17. An electrical contact element formed of a sheet metal material, comprising:

a first region;

a second region, wherein each one of the first and second regions is coated with a first coating including a first layer containing a first material having a lower standard electrode potential than the sheet metal material, wherein the first coating in the first and second regions includes a second layer which contains a second material having a lower standard electrode potential than the first material and which is arranged underneath the first layer and wherein the first coating further includes a third layer in the second region which is made of an alloy of a third material and arranged between the first and second layers, and wherein the third layer arranged between the first and second layers is also present in the first region; and a third region separated from the first region by the second region, wherein the third region is coated with a second coating comprising a first layer containing the first material, a second layer arranged between the sheet metal and the first layer and containing the second material, and optionally a third layer made of the alloy of the third material and arranged between the first and second layers.

18. An electrical contact element according to claim 17, wherein the second region defines a distance between the first region and the third region, the distance having a value between 1 mm and 8 mm.

19. The electrical contact element according to claim 17, wherein the first region forms at least a part of a fastening section of the electrical contact element for mechanically fastening the electrical contact element to a wire electrical cable and the second region forms at least a part of a connecting section of the electrical contact element for electrically connecting the electrical contact element to the wire electrical cable.

20. The electrical contact element according to claim 17, wherein the sheet metal is made of copper or a copper alloy, the first layer is made of a material having a standard electrode potential ranking between a standard electrode potential of the sheet metal material and a standard electrode potential of the wire electrical cable material, and/or the first layer is made of tin.

21. The electrical contact element according to claim 17, wherein the second layer forms a galvanic anode made of zinc.

22. The electrical contact element according to claim 17, wherein the alloy of the third layer contains copper and zinc.

23. The electrical contact element according to claim 17, wherein the alloy of the third layer is a copper zinc alloy containing zinc in an amount of 30% to 40% by weight.

24. The electrical contact element according to claim 17, wherein a hot dip tin layer is provided between the sheet metal and the first coating.

* * * * *